US012746431B2

(12) United States Patent
Chen

(10) Patent No.: US 12,746,431 B2
(45) Date of Patent: Sep. 29, 2026

(54) SQUAT DEPTH GAUGE

(71) Applicant: Che-Min Chen, Taoyuan City (TW)

(72) Inventor: Che-Min Chen, Taoyuan City (TW)

( * ) Notice: Subject to any disclaimer, the term of this patent is extended or adjusted under 35 U.S.C. 154(b) by 0 days.

(21) Appl. No.: 19/221,554

(22) Filed: May 29, 2025

(65) Prior Publication Data

US 2025/0375656 A1 Dec. 11, 2025

(30) Foreign Application Priority Data

Jun. 11, 2024 (TW) ..... 113121548

(51) Int. Cl.
*A63B 23/04* (2006.01)

(52) U.S. Cl.
CPC ... *A63B 23/0405* (2013.01); *A63B 2023/0411* (2013.01)

(58) Field of Classification Search
CPC ..... A63B 21/078; A63B 23/0205; A63B 23/0244; A63B 23/0405; A63B 71/06; A63B 71/0622; A63B 2023/0411; A63B 2071/0694; A63B 2220/20; A63B 2225/093; G01B 5/02
See application file for complete search history.

(56) References Cited

U.S. PATENT DOCUMENTS

| | | | | |
|---|---|---|---|---|
| 4,208,050 | A | 6/1980 | Perrine | |
| 4,471,532 | A | 9/1984 | Francis | |
| 4,762,317 | A | 8/1988 | Camfield et al. | |
| 5,031,903 | A | 7/1991 | Clarke | |
| 5,117,690 | A | 6/1992 | Baer | |
| 5,263,919 | A * | 11/1993 | Hollenback | A63B 21/00047 482/145 |
| 5,566,460 | A | 10/1996 | Bates | |
| 5,687,456 | A | 11/1997 | Chang | |
| 6,050,531 | A | 4/2000 | Wilcox | |
| 6,254,305 | B1 | 7/2001 | Taylor | |
| 6,461,074 | B2 | 10/2002 | Taylor | |
| 6,749,227 | B2 | 6/2004 | Margid | |
| 7,874,958 | B1 | 1/2011 | Ramsey, Sr. | |
| 9,050,493 | B2 | 6/2015 | Perez | |
| 9,095,742 | B2 * | 8/2015 | Henniger | A63B 21/0724 |
| 9,586,075 | B2 * | 3/2017 | Goodson | A63B 21/068 |
| 10,486,020 | B2 * | 11/2019 | Sadikaj | A63B 69/0062 |
| 10,722,010 | B2 | 7/2020 | Jay | |
| 10,870,046 | B2 | 12/2020 | Franklin | |
| 11,602,666 | B2 * | 3/2023 | Duenas | A63B 21/0085 |

(Continued)

FOREIGN PATENT DOCUMENTS

| | | | |
|---|---|---|---|
| CN | 202315069 | U | 7/2012 |
| CN | 204193397 | U | 3/2015 |

(Continued)

*Primary Examiner* — Joshua Lee

(74) *Attorney, Agent, or Firm* — CKC & Partners Co., LLC

(57) ABSTRACT

A squat depth gauge includes a base support frame, two rule rods, and an indicator member. The base support frame includes a first rod and two second rods disposed at opposite sides of the first stick. The length of the first rod in the first direction is adjustable. The base support frame is detachable. The rule rods stand at two opposite sides of the first rod. The rule rods include vertical scales which increasing from bottom to top. The indicator is detachably disposed on the rule rods to determine a distance from ground to the indicator member.

15 Claims, 7 Drawing Sheets

(56) References Cited

U.S. PATENT DOCUMENTS

| | | | | |
|---|---|---|---|---|
| 11,701,543 | B1 * | 7/2023 | Smith, Jr. | A63B 71/0036 482/104 |
| 11,883,715 | B1 * | 1/2024 | Howard | A63B 21/4037 |
| 12,161,902 | B1 * | 12/2024 | Whiteley | A63B 23/1218 |
| 12,280,307 | B2 | 4/2025 | DeFatta | |
| 12,303,446 | B2 * | 5/2025 | Christiansen | A63B 1/005 |
| 2008/0199839 | A1 | 8/2008 | Fugitt | |
| 2009/0137368 | A1 | 5/2009 | Parrilla | |
| 2010/0041531 | A1 | 2/2010 | Rochford | |
| 2012/0231937 | A1 * | 9/2012 | Murphy | A63B 23/1236 482/93 |
| 2017/0072242 | A1 * | 3/2017 | Drain, II | A63B 23/0405 |
| 2018/0056108 | A1 | 3/2018 | Kelly | |
| 2020/0101342 | A1 * | 4/2020 | Lawton | A63B 21/4033 |
| 2020/0405021 | A1 | 12/2020 | Heim | |
| 2024/0390732 | A1 * | 11/2024 | Purland | A63B 21/00181 |
| 2025/0032884 | A1 * | 1/2025 | DeFatta | A63B 23/0405 |

FOREIGN PATENT DOCUMENTS

| | | | |
|---|---|---|---|
| CN | 106110588 | A | 11/2016 |
| CN | 208145341 | U | 11/2018 |
| CN | 209286588 | U | 8/2019 |
| CN | 212282735 | U | 1/2021 |
| CN | 219048493 | U | 5/2023 |
| TW | M556617 | U | 3/2018 |
| WO | 2014068374 | A1 | 5/2014 |

* cited by examiner

SQUAT DEPTH GAUGE

CROSS-REFERENCE TO RELATED APPLICATION

This application claims priority to Taiwan Application Serial Number 113121548, filed Jun. 11, 2024, which is herein incorporated by reference in its entirety.

BACKGROUND

Field of Invention

The present disclosure relates to an auxiliary tool for squat exercises, and more particularly to a squat depth gauge.

Description of Related Art

With the continuous advancement of society, individuals have become increasingly conscious of health and physical fitness. Exercise and fitness have become indispensable parts of daily life. Among various exercise options, the squat has gained widespread popularity due to its effectiveness as a full-body training movement, particularly in strengthening the core and lower-body muscle groups. However, achieving optimal training outcomes requires precise control over body posture and movement during squats, which remains a critical concern for practitioners.

SUMMARY

One embodiment of the present disclosure provides a squat depth gauge, including a base support frame, two ruler rods, and an indicator member. The base support frame includes a first rod and second rods disposed on both sides of the first rod, wherein the length of the first rod in a first direction is adjustable. The base support frame is detachable. The ruler rods are vertically erected at both ends of the first rod and include a vertical scale, which increasing from bottom to top. The indicator member is detachably disposed on the ruler rods to determine the distance of the indicator member from the ground.

In some embodiments, the base support frame includes two L-shaped adapters, each of the L-shaped adapter includes two resilient arms and a sleeve. The resilient arms of the L-shaped adapters clamp onto the second rods, while the ruler rods are disposed within the sleeves of the L-shaped adapters.

In some embodiments, the base support frame includes two engagement pieces, each of the engagement piece includes two hooks. The L-shaped adapters and the first rod respectively include slots corresponding to the hooks, the L-shaped adapters are assembled to the first rod by engaging the hooks with the slots.

In some embodiments, the engagement pieces are shaped as right-angled triangles, with hooks provided on two side edges of each engagement piece.

In some embodiments, the indicator member includes an elastic cord and hooks provided at both ends of the elastic cord.

In some embodiments, the first rod includes at least a first sliding member and a second sliding member. The first sliding member is slidable relative to the second sliding member to adjust the length of the first rod in the first direction.

In some embodiments, the first rod includes a transverse scale disposed on the first sliding member. The first sliding member further includes a plurality of positioning holes corresponding to the transverse scale. The base support frame includes a positioning component to engage with one of the positioning holes to position the second sliding member relative to the first sliding member.

In some embodiments, the second rods are adjustable in length along a second direction.

In some embodiments, the second rods each include at least a third sliding member and a fourth sliding member. The third sliding member is slidable relative to the fourth sliding member to adjust the length of the second rod in the second direction.

In some embodiments, the second rod includes a longitudinal scale disposed on the third sliding member. The third sliding member further includes a plurality of positioning holes corresponding to the longitudinal scale. The base support frame includes two positioning components that respectively engage with one of the positioning holes on the third sliding member to position the fourth sliding member relative to the third sliding member.

In some embodiments, the base support frame further includes two weight blocks, which are disposed at the ends or midsections of the second rods.

In some embodiments, each ruler rod includes a basic ruler section having a first side surface and a second side surface, which are adjacent or opposite to each other. The vertical scale is disposed on the first side surface, and a plurality of holes corresponding to the vertical scale are disposed on the second side surface.

In some embodiments, the ruler rod further includes an additional ruler section that can be selectively assembled onto the basic ruler section.

In some embodiments, the squat depth gauge further includes a plurality of height range markers disposed along the ruler rods from bottom to top, wherein visual differentiation is provided between the height range markers.

In some embodiments, the first rod includes two detachable sliding members, each welded to the second rod, respectively.

The present disclosure provides a squat depth gauge that can be individually adjusted, allowing a user to determine whether the depth of their squat has reached a preset target by whether the user's hips come into contact with the indicator member. This facilitates correct squat training. Furthermore, the squat depth gauge can be adapted to various types of squat training apparatuses without requiring structural modifications to the apparatuses themselves, thereby enhancing the practicality of the squat depth gauge. Additionally, the squat depth gauge can be disassembled into multiple components, significantly reducing storage space and improving portability.

BRIEF DESCRIPTION OF THE DRAWINGS

To further illustrate the objectives, features, advantages, and embodiments of the present disclosure, the detailed descriptions of the accompanying drawings are provided as follows.

DETAILED DESCRIPTION

Figure 1:
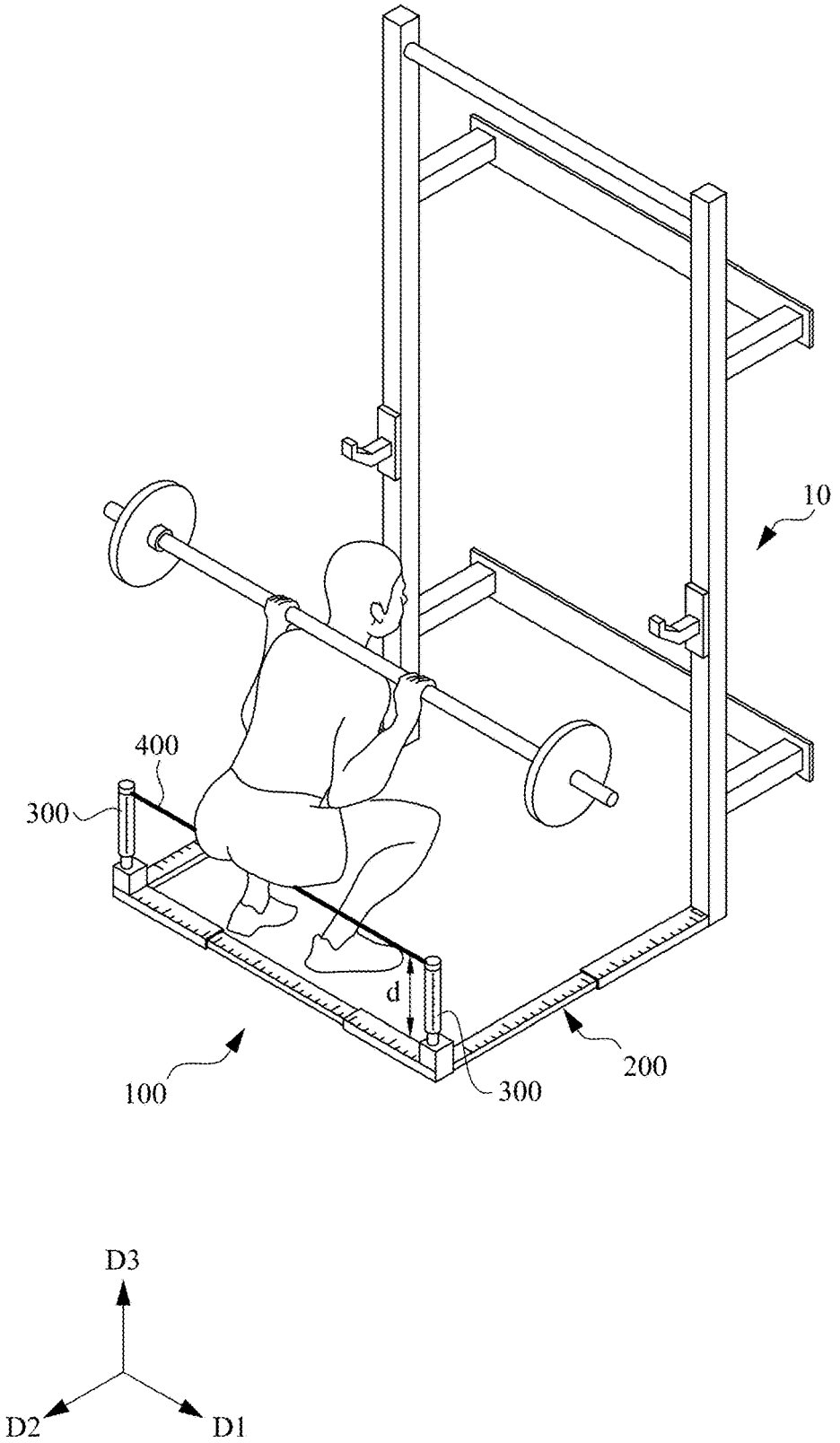
FIG. 1 is a schematic view illustrating an application example of a squat depth gauge according to some embodiments of the present disclosure.

The following detailed descriptions disclose multiple embodiments of the present disclosure with reference to the accompanying drawings. For purposes of clarity, numerous practical details are included in the following description. However, it should be understood that these practical details are not intended to limit the present disclosure. In certain embodiments, some practical details may not be necessary. Moreover, for simplicity, conventional structures and elements may be schematically illustrated in the drawings. Throughout the drawings, like reference numerals denote like or similar elements. Features of different embodiments may be interchangeably applied where practicable.

Some embodiments of the present disclosure provide a squat depth gauge that assists users in performing correct squat exercises and allows adjustment of squat depth based on individual body types and training styles. Furthermore, the components of the squat depth gauge are designed to be detachable, facilitating storage and portability.

Referring to FIG. 1, which is a schematic view illustrating an application example of the squat depth gauge according to some embodiments of the present disclosure, the squat depth gauge 100 may be configured to work with any type of squat apparatus 10 (also referred to as a squat rack). During squatting, the user can easily determine whether the squatting depth has reached a preset target depth, thereby promoting correct squat performance.

In some embodiments, the squat depth gauge 100 includes a base support frame 200, ruler rods 300 erected vertically on the base support frame 200, and an indicator member 400 movably disposed on the ruler rods 300. The width of the base support frame 200 can be adjusted to match the width of the squat apparatus 10, while the length of the base support frame 200 can be adjusted based on the user's body size so that the position of the indicator member 400 corresponds approximately to the area beneath the user's hips during squatting. In some embodiments, the base support frame 200 may be positioned in contact with, or apart from, the squat apparatus 10.

Each ruler rod 300 includes multiple graduations, and the indicator member 400 is movably configured on the ruler rod 300. Thus, the indicator member 400 can be positioned at a predetermined height along the ruler rod 300 according to the user's needs, thereby defining a distance "d" from the indicator member 400 to the ground, which serves as the target depth during squats.

Once the squat depth gauge 100 is properly set up, the user, during squatting, can determine whether the preset squat depth has been achieved based on whether the hips contact the indicator member 400, thereby facilitating correct squat performance. In some embodiments, the indicator member 400 may be made of an elastic material to provide a forgiving contact area, minimizing user discomfort and reducing the risk of falling caused by shifting body weight excessively onto the indicator member.

Figure 2:
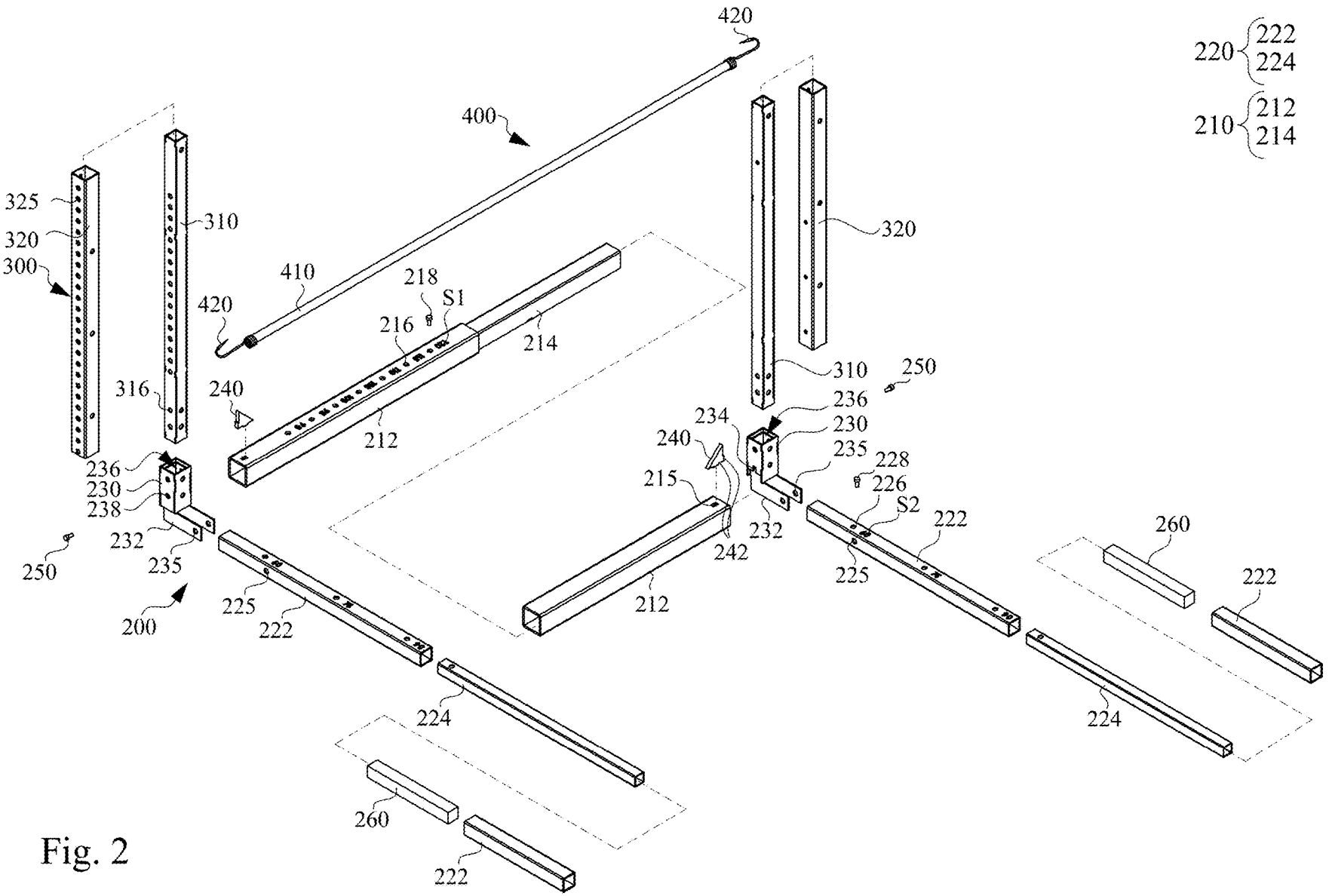
FIG. 2 is an exploded view of a squat depth gauge according to some embodiments of the present disclosure.

Referring to FIG. 2, which is an exploded view of the squat depth gauge according to some embodiments of the present disclosure, the squat depth gauge 100 includes the base support frame 200, ruler rods 300 erected thereon, and the indicator member 400.

In some embodiments, the base support frame 200 includes a first rod 210, two second rods 220, two L-shaped adapters 230, and two engagement pieces 240. Each second rod 220 is connected to opposite ends of the first rod 210 through the L-shaped adapters 230. The two ends of the first rod 210 are secured to the L-shaped adapters 230 via the engagement pieces 240, which also serve to enhance the structural integrity of the base support frame 200.

For example, the first rod 210 may include at least a first sliding member 212 and a second sliding member 214. The first sliding member 212 is slidable relative to the second sliding member 214 to adjust the length of the first rod 210, particularly in the first direction D1, corresponding to the width of the squat apparatus 10 as illustrated in FIG. 1. In some embodiments, the first sliding member 212 and the second sliding member 214 are coaxially arranged, wherein the first sliding member 212 has a larger inner diameter allowing the second sliding member 214 to be disposed inside it. In other embodiments, the first sliding member 212 and the second sliding member 214 are arranged side-by-side, configured to slide relative to each other in a rail-like configuration.

At least one first sliding member 212 is provided with a transverse scale S1, and corresponding positioning holes 216 are formed at predetermined intervals along the transverse scale S1. For example, positioning holes 216 may be located at positions corresponding to 90 cm, 95 cm, 100 cm, 105 cm, 110 cm, 115 cm, and 120 cm. A positioning component 218, such as a pin, screw, or detent ball, may be inserted into a selected positioning hole 216 to serve as a stopper, thereby securing the second sliding member 214 relative to the first sliding member 212. In this manner, the length of the first rod 210 can be adjusted to match the width of the squat apparatus 10 as shown in FIG. 1.

For example, the second rod 220 includes at least a third sliding member 222 and a fourth sliding member 224. The third sliding member 222 is slidable relative to the fourth sliding member 224 to adjust the length of the second rod 220 along a second direction D2, corresponding to the distance between the user and the squat apparatus 10 as shown in FIG. 1.

In some embodiments, the third sliding member 222 and the fourth sliding member 224 are coaxially arranged, wherein the third sliding member 222 has a larger inner diameter allowing the fourth sliding member 224 to be inserted therein. In other embodiments, the third sliding member 222 and the fourth sliding member 224 are arranged side-by-side and configured to slide relative to each other in a rail-like configuration.

At least one third sliding member 222 is provided with longitudinal scale S2, and a plurality of positioning holes 226 are formed at predetermined positions corresponding to the longitudinal scaleS2, such as at 60 cm, 75 cm, and 90 cm. A positioning component 228, such as a pin, screw, or detent ball, can be inserted into a selected positioning hole 226 to serve as a stopper, thereby securing the fourth sliding member 224 relative to the third sliding member 222. In this manner, the length of the second rod 220 can be adjusted.

Due to differences in user body types and movement habits, the length of the second rod 220 generally serves as an initial adjustment. Accordingly, the interval spacing of the longitudinal scale S2 may be larger than that of the transverse scale S1 on the first rod 210.

For example, each L-shaped adapter 230 includes two resilient arms 232. When the second rod 220 is assembled to the L-shaped adapter 230, the resilient arms 232 clamp onto the third sliding member 222 of the second rod 220.

In some embodiments, the resilient arms 232 of the L-shaped adapter 230 and the third sliding member 222 of the second rod 220 are respectively provided with locking holes 235 and 225. A locking component 250, such as a screw, can be inserted through the locking holes 235 and 225 to securely connect the second rod 220 to the L-shaped adapter 230. In other embodiments, the second rod 220 and the L-shaped adapter 230 may alternatively be assembled via snap-fit engagement or detent mechanisms.

For example, the engagement piece 240 may be shaped as a right-angled triangle and include hooks 242 disposed on its two side edges. The L-shaped adapter 230 includes slots 234 corresponding to the hooks 242, and the first sliding member 212 of the first rod 210 also includes slots 215 corresponding to the hooks 242. After the first rod 210 is positioned adjacent to the L-shaped adapter 230, the hooks 242 of the engagement piece 240 are engaged with the slots 234 of the L-shaped adapter 230 and the slots 215 of the first sliding member 212, thereby enabling a tool-free assembly between the first rod 210 and the L-shaped adapter 230.

Because the engagement piece 240 may be shaped as a right-angled triangle, after the base support frame 200 is fully assembled, the two side edges of the engagement piece 240 can respectively contact the first rod 210 and the L-shaped adapter 230. This arrangement not only reinforces the structural strength of the squat depth gauge 100 but also helps prevent tilting of the L-shaped adapter 230 and the ruler rod 300 mounted thereon relative to the first rod 210, especially during use when downward force is applied by the user's hips contacting the indicator member 400.

For example, the indicator member 400 includes an elastic cord 410 and hooks 420 disposed at both ends of the elastic cord 410. Due to the stretchable nature of the elastic cord 410, it can accommodate changes in the length of the first rod 210 (corresponding to the width of the squat apparatus 10) without sagging excessively or creating excessive tension. The elasticity of the indicator member 400 also increases the permissible contact range between the user and the indicator member 400, thereby reducing discomfort and minimizing the risk of the user inadvertently shifting too much weight onto the indicator member 400 and falling.

In some embodiments, the indicator member 400 is fixed to the ruler rod 300 by engaging the hooks 420 at both ends of the elastic cord 410 into holes 315 formed on the ruler rod 300. In other embodiments, the hooks 420 at both ends of the elastic cord 410 may be made of magnetic material, and the ruler rod 300 may be provided with magnets, thereby enabling the elastic cord 410 to be magnetically attached and positioned on the ruler rod 300. In yet other embodiments, the indicator member 400 is not limited to an elastic cord configuration and may alternatively be a horizontal bar, provided that the indicator member 400 can be movably disposed on the ruler rod 300.

For example, the ruler rod 300 includes a basic ruler section 310 and an additional ruler section 320. The L-shaped adapter 230 includes a sleeve 236, wherein the extending direction of the sleeve 236 is perpendicular to the extending direction of the resilient arms 232. The basic ruler section 310 and the sleeve 236 are respectively provided with locking holes 316 and 238. A locking component 250, such as a screw, may be inserted into the locking holes 316 and 238 to securely connect the basic ruler section 310 to the L-shaped adapter 230. In other embodiments, the ruler rod 300 and the L-shaped adapter 230 may alternatively be assembled via snap-fit engagement or detent mechanisms.

Figure 3:
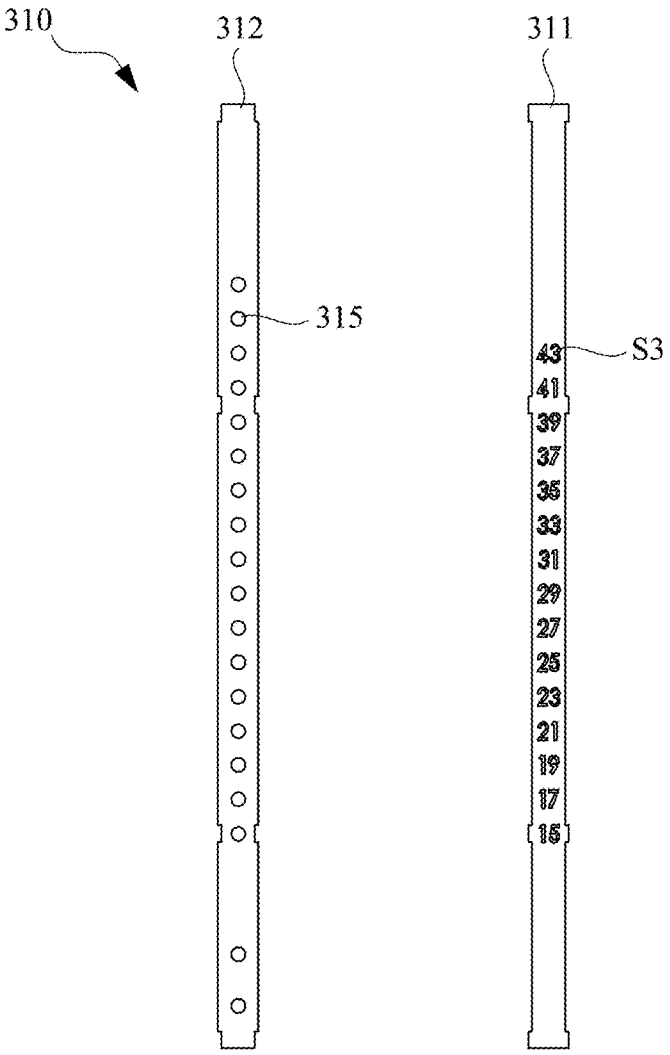
FIG. 3 is a schematic view illustrating different side surfaces of a ruler rod according to some embodiments of the present disclosure.

Referring simultaneously to FIGS. 2 and 3, where FIG. 3 is a schematic view illustrating different side surfaces of the ruler rod according to some embodiments of the present disclosure, at least one side surface of the basic ruler section 310, such as a first side surface 311, is provided with vertical scale S3. The vertical scale S3 incrementally increase from bottom to top, corresponding to heights measured from the ground along a third direction D3 as shown in FIG. 1.

At least one side surface of the basic ruler section 310, such as a second side surface 312, is provided with a plurality of holes 315 corresponding to the vertical scale S3. The hooks 420 of the indicator member 400 are assembled into these holes 315. In some embodiments, the first side surface 311 may be adjacent to the second side surface 312, whereas in other embodiments, the first side surface 311 may be disposed opposite the second side surface 312.

The additional ruler section 320 is selectively attachable to the basic ruler section 310. For example, the additional ruler section 320 may be assembled onto the basic ruler section 310 via a snap-fit engagement or a detent mechanism. The additional ruler section 320 includes vertical scaleS3' (refer to FIG. 4A) and a plurality of holes 325 corresponding to the vertical scaleS3'. The range of the vertical scale S3' of the additional ruler section 320 differs from that of the vertical scale S3 of the basic ruler section 310.

More specifically, the range of the vertical scale S3' may continue from the range of the vertical scale S3, allowing the overall scale markings on the ruler rod 300 to continuously increase from bottom to top.

If the user performs a squat at a relatively lower depth within the range indicated by the vertical scale S3 of the basic ruler section 310, only the basic ruler section 310 may be used as a reference. However, if the user's squat depth exceeds the range indicated by the basic ruler section 310, the additional ruler section 320 can be attached to the basic ruler section 310, and the vertical scale S3' on the additional ruler section 320 can be used as a reference.

In some embodiments, the squat depth gauge 100 further includes at least one weight block 260 disposed within the base support frame 200. The weight block 260 may be installed within the first rod 210 and/or the second rods 220 of the base support frame 200.

In some embodiments, the squat depth gauge 100 includes two weight blocks 260 respectively disposed at the distal ends of the two second rods 220, i.e., at ends farther from the L-shaped adapters 230. In other embodiments, the weight blocks 260 may alternatively be positioned in the midsections of the first rod 210 and/or the second rods 220, such as within the second sliding member 214 and/or the fourth sliding member 224, effectively forming a solid structure for these sliding members.

The weight blocks 260 can increase the downward force between the base support frame 200 and the ground, thereby enhancing the stability of the configuration. Furthermore, the weight blocks 260 help prevent tilting of the indicator member 400 and the ruler rod 300 mounted thereon when downward pressure is applied, particularly when the user's hips contact the indicator member 400 during exercise.

Figure 4A:
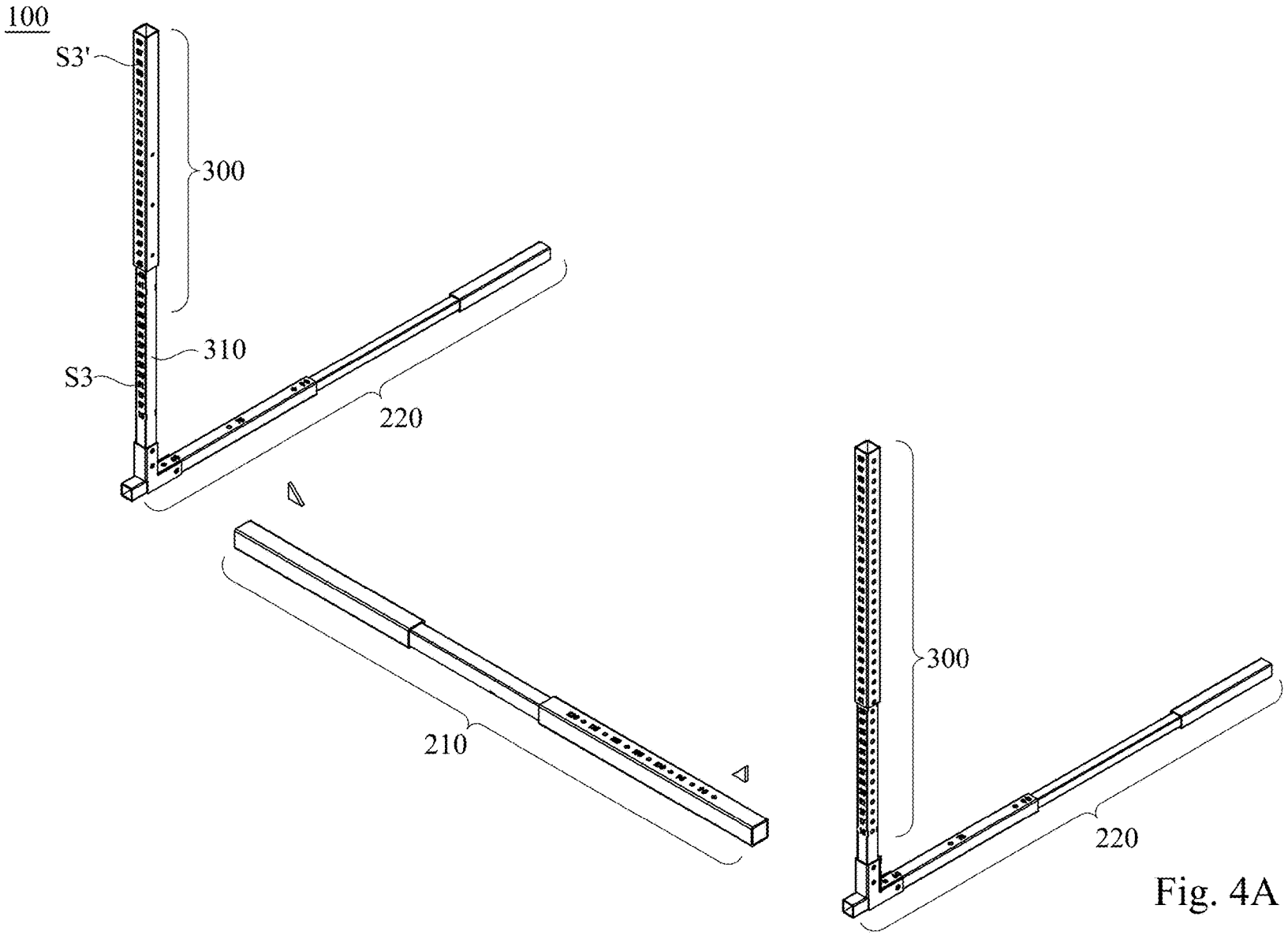
FIGS. 4A and 4B are schematic views illustrating different disassembly stages of a squat depth gauge according to some embodiments of the present disclosure.
Figure 4B:
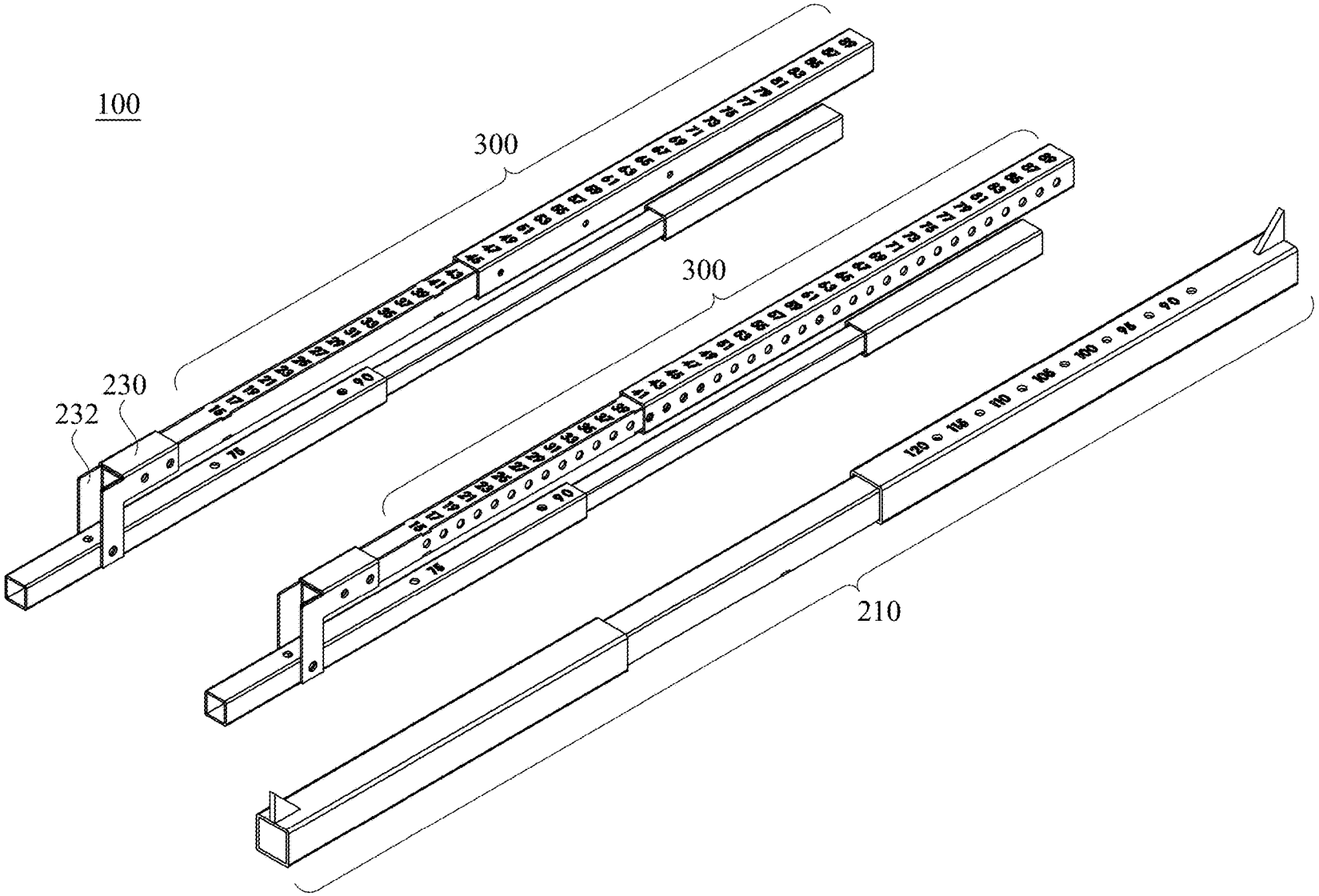

Referring to FIGS. 4A and 4B, which are schematic views illustrating different disassembly stages of the squat depth gauge according to some embodiments of the present disclosure, since the first rod 210 and the two second rods 220 are respectively extendable and retractable, the user can easily shorten both the first rod 210 and the second rods 220 when the squat depth gauge 100 is not in use, thereby effectively reducing the space occupied by the squat depth gauge 100 for convenient storage and portability.

Moreover, when the squat depth gauge 100 needs to be stored or transported, the user can simply remove the engagement pieces 240 to detach the first rod 210 from the L-shaped adapters 230, as illustrated in FIG. 4A. At this stage, the second rods 220 and the ruler rods 300 can remain assembled with the L-shaped adapters 230. By adjusting the connection angle between the L-shaped adapters 230 and the second rods 220, such as pivoting the resilient arms 232 of the L-shaped adapters 230 relative to the second rods 220, the ruler rods 300 can be arranged parallel to the second rods 220, as shown in FIG. 4B.

This configuration significantly reduces the space required by the squat depth gauge 100, facilitating easier storage and transportation.

Figure 5:
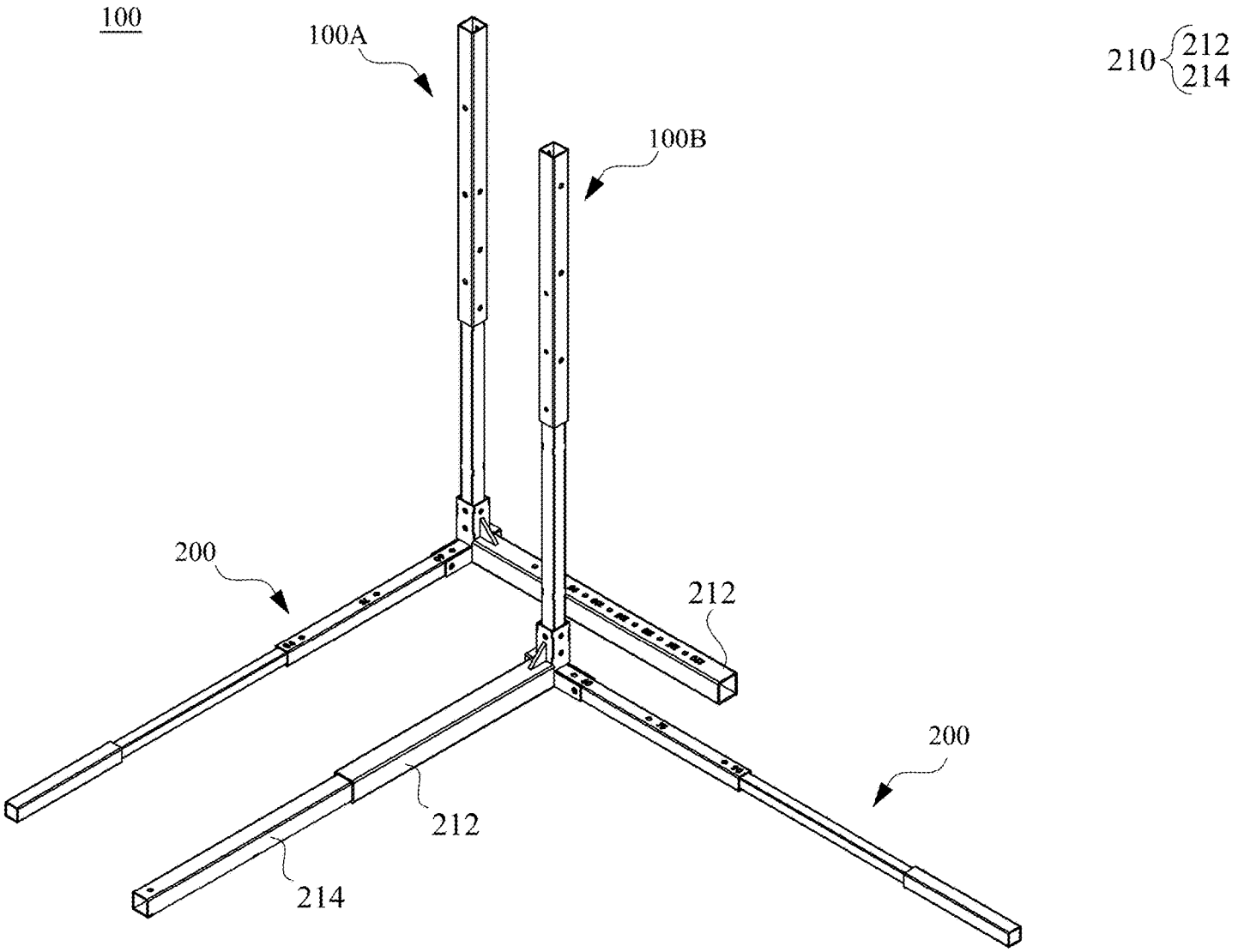
FIG. 5 is a disassembled schematic view of a squat depth gauge according to other embodiments of the present disclosure.

Referring to FIG. 5, which is a disassembled schematic view of a squat depth gauge according to other embodiments of the present disclosure, in certain embodiments, the first sliding member 212 and the second sliding member 214 of the first rod 210 of the base support frame 200 may be detachably configured. That is, when it is desired to store the squat depth gauge 100, the second sliding member 214 can be directly removed from the first sliding member 212, allowing the squat depth gauge 100 to be separated into two main components, 100A and 100B. These two main components 100A and 100B can be leaned against a wall for compact storage, thereby effectively reducing the space occupied by the squat depth gauge 100.

In some embodiments, the squat depth gauge 100 as shown in FIG. 5 may further be folded as illustrated in FIGS. 4A and 4B to facilitate portability. In other embodiments, components such as the L-shaped adapters 230, the first sliding member 212 of the first rod 210, the engagement pieces 240, and the third sliding members 222 of the second rods 220 may be welded or integrally formed to reduce manufacturing costs.

Figure 6:
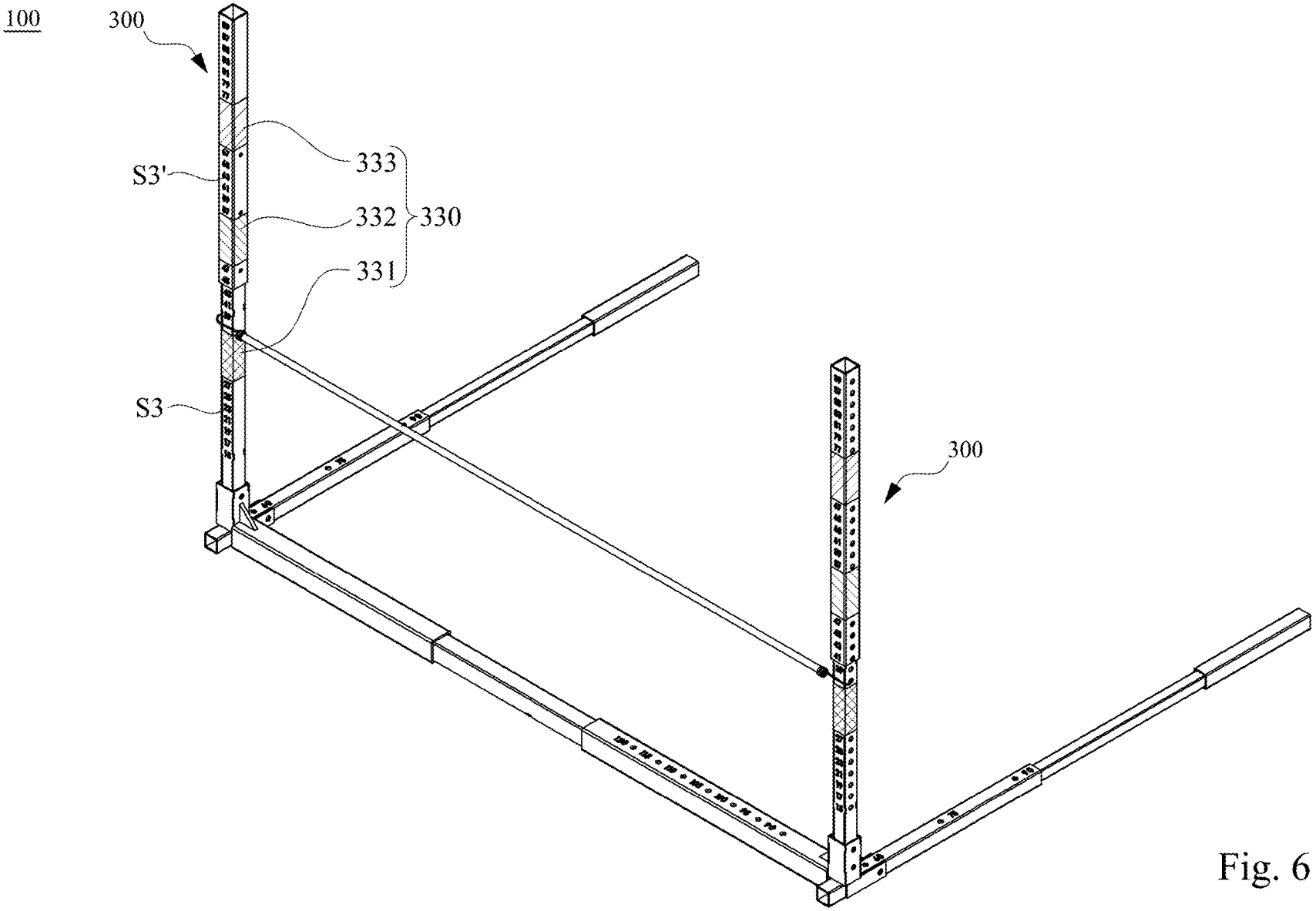
FIG. 6 is a perspective view of a squat depth gauge according to further embodiments of the present disclosure.

Referring to FIG. 6, which is a perspective view of a squat depth gauge according to further embodiments of the present disclosure, different squat training modes may require different target squat depths.

For example, when performing a parallel squat, the ideal squat depth corresponds to a knee joint angle of approximately 60 to 70 degrees; for a half squat, approximately 80 to 100 degrees; and for a quarter squat, approximately 110 to 140 degrees. Among these squat types, the squat depth for a parallel squat is deeper than that of a half squat, and the squat depth for a half squat is deeper than that of a quarter squat.

As previously described, the vertical scale S3 of the ruler rod 300 incrementally increase from bottom to top, corresponding to the height measured from the ground. To allow the user to intuitively select the desired squat depth and reduce the need to convert between squat depth and ground height, the squat depth gauge 100 may further include height range markers 330 on the ruler rod 300.

For example, the height range markers 330 sequentially include a first height range marker 331, a second height range marker 332, and a third height range marker 333 from bottom to top. The first height range marker 331 corresponds to a squat depth range suitable for parallel squats, the second height range marker 332 corresponds to a squat depth range suitable for half squats, and the third height range marker 333 corresponds to a squat depth range suitable for quarter squats.

In some embodiments, the first height range marker 331, second height range marker 332, and third height range marker 333 may have distinct visual differentiations to enable users to intuitively select the desired squat depth. For example, the different height range markers may be represented by different colors, bold separator lines, washers, or other visual indicators.

The present disclosure provides a squat depth gauge that can be personalized and adjusted, allowing users to determine whether their squatting depth has reached a preset target based on whether their hips contact the indicator member. This assists users in performing squats correctly. Moreover, the squat depth gauge is adaptable to various types of squat training equipment without requiring structural modifications to the equipment, thereby enhancing the practicality of the device.

Additionally, the squat depth gauge can be disassembled into multiple components, effectively reducing its occupied space and facilitating storage and portability.

Although the present disclosure has been described with reference to certain preferred embodiments, it is to be understood that the embodiments are illustrative and not restrictive. Various modifications and alterations will be apparent to those skilled in the art without departing from the spirit and scope of the present disclosure, and the protection scope of the present disclosure shall be defined by the appended claims.

What is claimed is:

1. A squat depth gauge, comprising:

a base support frame comprising a first rod and two second rods disposed on opposite sides of the first rod, wherein a length of the first rod along a first direction is adjustable, and wherein the base support frame is detachable;

two ruler rods vertically erected at both ends of the first rod, each of the ruler rods having a vertical scale, which increases from bottom to top; and an indicator member detachably disposed on the ruler rods to determine a distance from ground to the indicator member.

2. The squat depth gauge of claim 1, wherein the base support frame comprises:

two L-shaped adapters, each comprising two resilient arms and a sleeve, wherein the resilient arms of the L-shaped adapters are configured to clamp the second rods, and the ruler rods are disposed within the sleeves of the L-shaped adapters.

3. The squat depth gauge of claim 2, wherein the base support frame further comprises:

two engagement pieces, each comprising two hooks, wherein the L-shaped adapters and the first rod respectively include a plurality of slots corresponding to the hooks, and wherein the L-shaped adapters are assembled to the first rod by engaging the hooks with the slots.

4. The squat depth gauge of claim 3, wherein each of the engagement pieces is shaped as a right-angled triangle, and the hooks are disposed on two side edges of each engagement piece.

5. The squat depth gauge of claim 1, wherein the indicator member comprises an elastic cord and two hooks disposed at opposite ends of the elastic cord.

6. The squat depth gauge of claim 1, wherein the first rod comprises at least a first sliding member and a second sliding member, wherein the first sliding member is slidable relative to the second sliding member to adjust the length of the first rod along the first direction.

7. The squat depth gauge of claim 6, wherein the first rod comprises a transverse scale disposed on the first sliding member, wherein the first sliding member comprises a plurality of positioning holes corresponding to the transverse scale, and wherein the base support frame comprises a positioning component configured to engage with one of the positioning holes to position the second sliding member relative to the first sliding member.

8. The squat depth gauge of claim 1, wherein each of the second rods is adjustable in length along a second direction.

9. The squat depth gauge of claim 8, wherein each second rod comprises at least a third sliding member and a fourth sliding member, wherein the third sliding member is slidable relative to the fourth sliding member to adjust the length of the second rod along the second direction.

10. The squat depth gauge of claim 9, wherein each second rod includes a longitudinal scale disposed on the third sliding member, wherein the third sliding member comprises a plurality of positioning holes corresponding to the longitudinal scale, and wherein the base support frame comprises two positioning components, each of the positioning components is configured to engage with one of the positioning holes to position the fourth sliding member relative to the third sliding member.

11. The squat depth gauge of claim 1, wherein the base support frame comprises two weight blocks disposed at ends or midsections of the second rods.

12. The squat depth gauge of claim 1, wherein each ruler rod comprises a basic ruler section having a first side surface and a second side surface that are adjacent or opposite to each other, wherein the vertical scale is disposed on the first side surface, and wherein the basic ruler section includes a plurality of holes corresponding to the vertical scale, the holes are disposed on the second side surface.

13. The squat depth gauge of claim 12, wherein each ruler rod further comprises an additional ruler section optionally assembled onto the basic ruler section.

14. The squat depth gauge of claim 1, further comprising a plurality of height range markers disposed along the ruler rods from bottom to top, wherein visual differentiation is provided between the plurality of height range markers.

15. The squat depth gauge of claim 1, wherein the first rod comprises two detachable sliding members, wherein each of the sliding members is welded to the second rod, respectively.

* * * * *